US009260888B1

(12) United States Patent
Yun

(10) Patent No.: US 9,260,888 B1
(45) Date of Patent: Feb. 16, 2016

(54) DOOR LOCK DEVICE FOR REFRIGERATOR AND FREEZER

(71) Applicant: KONG JIN CO., LTD, Gunpo-si (KR)

(72) Inventor: Kyu Jung Yun, Seongnam-si (KR)

(73) Assignee: KONG JIN CO., LTD, Gunpo-Si (KR)

( * ) Notice: Subject to any disclaimer, the term of this patent is extended or adjusted under 35 U.S.C. 154(b) by 0 days.

(21) Appl. No.: 14/434,895

(22) PCT Filed: Feb. 11, 2014

(86) PCT No.: PCT/KR2014/001129
§ 371 (c)(1),
(2) Date: Apr. 10, 2015

(87) PCT Pub. No.: WO2014/181955
PCT Pub. Date: Nov. 13, 2014

(30) Foreign Application Priority Data

May 7, 2013 (KR) ..... 10-2013-0051410

(51) Int. Cl.

| | |
|---|---|
| ***E05B 65/10*** | (2006.01) |
| ***E05B 65/00*** | (2006.01) |
| ***E05B 33/00*** | (2006.01) |
| ***E05B 41/00*** | (2006.01) |
| ***E05C 1/10*** | (2006.01) |
| *E05C 1/12* | (2006.01) |
| *E05C 1/14* | (2006.01) |

(52) U.S. Cl.
CPC ..... *E05B 65/005* (2013.01); *E05B 33/00* (2013.01); *E05B 41/00* (2013.01); *E05C 1/10* (2013.01); *E05B 65/0053* (2013.01); *E05C 1/12* (2013.01); *E05C 1/14* (2013.01); *Y10S 292/71* (2013.01)

(58) Field of Classification Search
CPC ... E05B 65/0053; E05B 65/005; E05B 41/00; E05B 33/00; E05C 1/10; E05C 1/12; E05C 1/14; Y10S 292/71
USPC ..... 70/470, 471, 481–485, 467, 468, 489, 70/92, 465, 208, 210, 432; 292/21, 92, 292/336.3, DIG. 31, DIG. 65, DIG. 71
See application file for complete search history.

(56) References Cited

U.S. PATENT DOCUMENTS 2,784,993 A * 3/1957 Collar ..... E05B 57/00 292/223
4,508,377 A * 4/1985 Takasaki ..... E05B 65/0053 292/166
4,519,641 A * 5/1985 Fujiya ..... E05B 65/0053 292/126
4,559,796 A * 12/1985 De Forrest, Sr. ..... E05B 41/00 70/432

(Continued)

FOREIGN PATENT DOCUMENTS

KR 10-2000-0066917 11/2000
KR 10-0321873 1/2002

(Continued)

*Primary Examiner* — Lloyd Gall
(74) *Attorney, Agent, or Firm* — Lex IP Meister, PLLC

(57) ABSTRACT

The present invention relates to a door lock device for a door of a refrigerator and freezer, and more particularly, to a door lock device for a door of a refrigerator and freezer that is configured to improve the coupling structure of an outer case and an inner case, thus preventing the inner case fixed by bolts to the surface of the door from being disassembled to the outside, and to reduce the whole volumes and the number of parts of opening and closing structure and releasing structure adapted to open and close the door, thus making it easy to perform assembling and installing processes.

11 Claims, 7 Drawing Sheets

(56) References Cited

U.S. PATENT DOCUMENTS 4,635,977 A * 1/1987 Yamada ..... E05B 65/0053 292/166
4,650,230 A * 3/1987 Takasaki ..... E05C 1/14 292/173
4,704,882 A * 11/1987 Takasaki ..... E05B 65/0053 292/173
4,740,022 A * 4/1988 Takahashi ..... E05B 17/002 292/217
5,219,385 A * 6/1993 Yeh ..... E05B 65/1046 292/169.13
5,490,697 A * 2/1996 Surko, Jr. ..... E05B 63/0069 292/196
6,877,346 B1 * 4/2005 Finkelstein ..... E05B 17/0075 292/92
2004/0187533 A1 * 9/2004 Huang ..... E05B 41/00 70/432
2006/0162404 A1 * 7/2006 Hsieh ..... E05B 41/00 70/71
2008/0000277 A1 * 1/2008 Yu ..... E05B 29/00 70/432
2011/0016938 A1 * 1/2011 Chi ..... E05B 41/00 70/432

FOREIGN PATENT DOCUMENTS

KR 20-0290648 10/2002
KR 10-2010-0101899 9/2010

* cited by examiner

DOOR LOCK DEVICE FOR REFRIGERATOR AND FREEZER

BACKGROUND OF THE INVENTION

1. Field of the Invention

The present invention relates to a door lock device for a door of a refrigerator and freezer, and more particularly, to a door lock device for a door of a refrigerator and freezer that is configured to improve the coupling structure of an outer case and an inner case, thus preventing the inner case fixed by means of bolts to the surface of the door from being disassembled to the outside, and to reduce the whole volumes and the number of parts of opening and closing means and releasing means adapted to open and close the door, thus making it easy to perform assembling and installing processes.

2. Background of the Related Art

Generally, a refrigerator and freezer is used to keep articles to be cooled and frozen therein temporarily or for a long period of time, thus preventing them from being decayed, and on the other hand, a door lock device is mounted on a panel of a door.

So as to mount the door lock device on the panel of the door, first, a case is mounted on the panel of the door, and an operating lever is coupled to a handle connected to the case by means of a pin shaft. Next, one end of the operating lever is connected to a latch, and the latch is supported against an elastic spring in such a manner as to be reciprocated. The case has a frame having fixing holes formed on both sides thereof in such a manner as to fix the case to the panel of the door by means of bolts or rivets, and a base plate is coupled to the underside of the case by means of bolts.

An example of conventional door lock devices for the door of the refrigerator and freezer is disclosed in Korean Patent No. 10-1012814, wherein the door lock device includes: a case having an inner case having fixing frames formed on both side surfaces thereof in such a manner as to fix the inner case to a door panel by means of bolts, rivet holes and a shaft hole formed on the upper portions of the side surfaces of the inner case, a base frame fixed to the underside of the inner case by means of bolts, a cam insertion hole formed on the center of the rear portion of the base frame, and an outer case coupled to the outer edges of the inner case; opening and closing means having an outer handle whose one end is inserted into the shaft hole of the inner case and fixed by means of a center shaft, a guide member and an operating lever inserted sequentially into the interior of the outer handle in such a manner as to be coupled to the center shaft on their one end and to a cooperatively operating shaft coupled to the outer handle, and a latch and an operating plate disposed on the lower end of the operating lever in such a manner as to be reciprocated forward and backward by the operations of the outer handle and the operating lever; locking means having a locking plate whose one end is fixed to the inside of the base frame by means of bolts, a pressing portion disposed on the other end of the locking plate in such a manner as to be ascended and descended by means of an elastic force of a spring to control the operation of the latch, and a lock coupled to the top portion of the inner case in such a manner as to press and release the pressing portion of the locking plate; and releasing means having a housing coupled to an inner handle in such a manner as to be fixed to the rear surface of the door panel by means of bolts, a rotary shaft coupled to the inner handle in such a manner as to be penetrated into the cam insertion hole of the base frame on one end thereof, a rotary cam fitted to the end periphery of the rotary shaft, and rotary protrusions protruding from both sides of the top end periphery of the rotary cam in such a manner as to fix one end of the operating plate thereto, so that if the rotary shaft and the rotary cam rotate, the operating plate pulls the latch to release the locking state of the outer handle. Under the above-mentioned configuration, the conventional door lock device becomes complicated in the whole coupling structures and has the difficulties in the assembling and disassembling processes, thus making the productivity of the product lowered.

According to the conventional door lock device, the inner case and the outer case are fixed to each other by means of rivets R, and if the rivets R are forcedly removed, the outer case is easily separated from the inner case.

According to the conventional door lock device, the guide member and the operating lever coupled to the outer handle and the operating plate coupled to the latch become complicated in configurations and have many difficulties in assembling process, and further, it is hard to maintain the state where a locking piece of the locking plate is rigidly fixed to a locking protrusion of the latch. Besides, the elastic force of the spring supporting the locking plate may be reduced or the spring may be escaped from its original position, thus failing to release the locking state of the latch.

Accordingly, the conventional door lock device has many difficulties in the whole assembling processes and the maintenance process, thus undesirably increasing the product cost and the maintenance cost.

SUMMARY OF THE INVENTION

Accordingly, the present invention has been made in view of the above-mentioned problems occurring in the prior art, and it is an object of the present invention to provide a door lock device for a door of a refrigerator and freezer that is configured to improve the coupling structure of an inner case and an outer case and at the same time to reduce the whole volumes and the number of parts of opening and closing means and releasing means adapted to open and close the door, thus easily making them in an economical way, making it easy to perform assembling and installing processes, and making it simple to perform exchanging of parts and maintenance work.

It is another object of the present invention to provide a door lock device for a door of a refrigerator and freezer that is configured wherein fixing protrusions protrude from both side surfaces of an inner case fixed by means of bolts to the surface of the door in such a manner as to be press-fitted to fixing grooves formed on the inside of the front portion of an outer case and a locking protrusion formed on the inside of the rear portion of the outer case is rigidly fixed to a locking groove of the inner case, thus preventing the inner case from being exposed to the outside and making it impossible to disassemble the inner case to the outside.

It is yet another object of the present invention to provide a door lock device for a door of a refrigerator and freezer that is configured to minimize operating relations wherein a fixing portion of a locking plate fixed to a latch as opening and closing means is fixed to and escaped from a locking groove of a rotary cam, thus allowing the latch to be rapidly open, and to have guide plates disposed at the inside of the inner case, thus preventing the locking plate from being distorted upon the movement of the latch.

It is still another object of the present invention to provide a door lock device for a door of a refrigerator and freezer that is configured to have a transparent window coupled to the top plate of an outer case and key locking and releasing display means mounted under the transparent window, so that if a latch is released, a color of a releasing display portion is exposed to the outside through the transparent window, and if the latch is locked, a color of a locking display portion is exposed to the outside through the transparent window, thus making it easy to recognize the colors by the naked eyes of a user and checking the locking states of an outer handle and the latch.

To accomplish the above-mentioned objects, according to the present invention, there is provided a door lock device for a door of a refrigerator and freezer, the device including: a case having an inner case fixed to the door by means of bolts, a base plate fixed to the underside of the inner case by means of bolts in such a manner as to close the interior of the inner case, fixing frames formed on both side surfaces of the inner case and having fixing protrusions protruding from the front portions thereof, a locking groove formed at the inside of the rear portion of the inner case, and an outer case having fixing grooves formed at the inside thereof in such a manner as to allow the fixing protrusions of the inner case to be press-fitted thereto and a locking protrusion formed on the inside of the rear portion thereof in such a manner as to be fixed to the locking groove of the inner case; opening and closing means having an outside handle having an operating lever disposed on the front portion thereof in such a manner as to be fixed on one end thereof to the inner case by means of a hinge shaft, the other end of the outside handle being extended to the rear portion of the outer case, and a latch disposed between the inner case and the base plate in such a manner as to allow the operating lever of the outer handle to be brought into close contact with a hinge shaft coupled to the rear portion thereof, so that the hinge shaft and the latch move backward to open the door; locking means having a fixing plate inserted into the inside of the rear portion of the base plate, pushing inducing protrusions protruding upward from the rear portion of the fixing plate, a rotary cam penetrated into the inside of the fixing plate in such a manner as to allow the lower peripheral portion thereof to protrude from the underside of the base plate, rotary protrusions formed on both sides of the front portion of the rotary cam in such a manner as to allow the fixing plate to be brought into close contact with the base plate, a locking groove formed on the center of the rotary protrusions, a guide protrusion extended forward from the locking groove, a locking plate fixed to the hinge shaft of the latch and having a pressing portion formed on the front portion thereof and a fixing portion formed on the rear portion thereof in such a manner as to be brought into close contact with the locking groove of the rotary cam and escaped therefrom through the seesaw operation of the pressing portion, a key spindle and a key housing coupled to the top plate of the outer case, and a locking protrusion protruding from the underside of the key housing in such a manner as to press and release the pressing portion; and releasing means having an inner handle having a rotary shaft inserted into the inside of the rotary cam protruding from the underside of the base plate in such a manner as to allow the rotary protrusions of the rotary cam to lift the fixing portion of the locking plate upward through the rotation of the inner handle and to allow the fixing portion to be escaped from the guide protrusion, so that the rotary protrusions of the rotary cam push the pushing inducing protrusions backward to release the locking state of the latch.

According to the present invention, preferably, the key locking and releasing display means has a transparent window disposed on the top plate of the outer case in such a manner as to allow the locking and releasing states of the key spindle and the latch to be easily recognized therethrough by the naked eyes of a user.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Hereinafter, an explanation on a door lock device for a door of a refrigerator and freezer according to the present invention will be in detail given with reference to the attached drawing.

Figure 1:
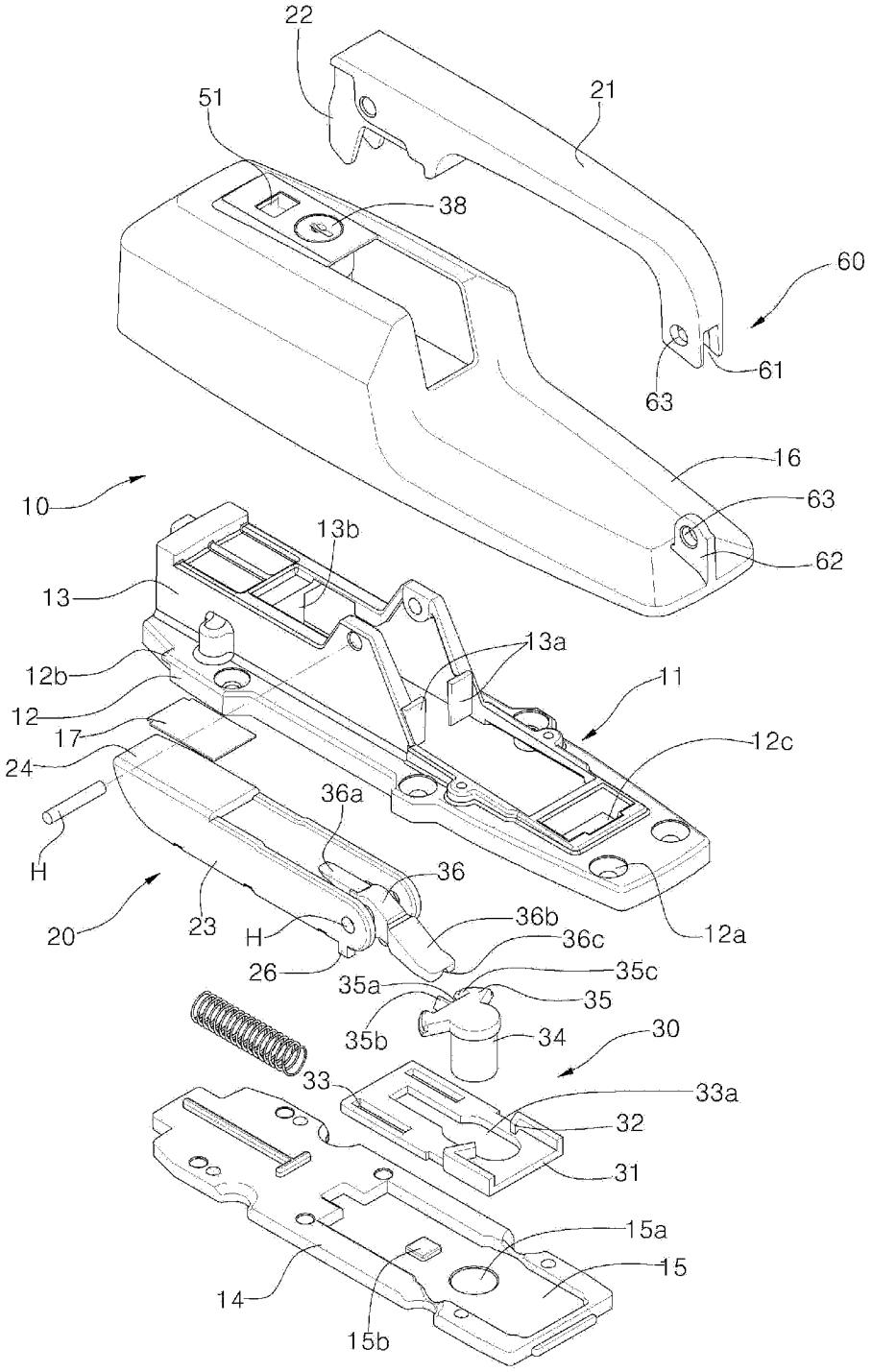
FIG. 1 is a perspective view showing the separated state of a door lock device for a door of a refrigerator and freezer according to the present invention.
Figure 2:
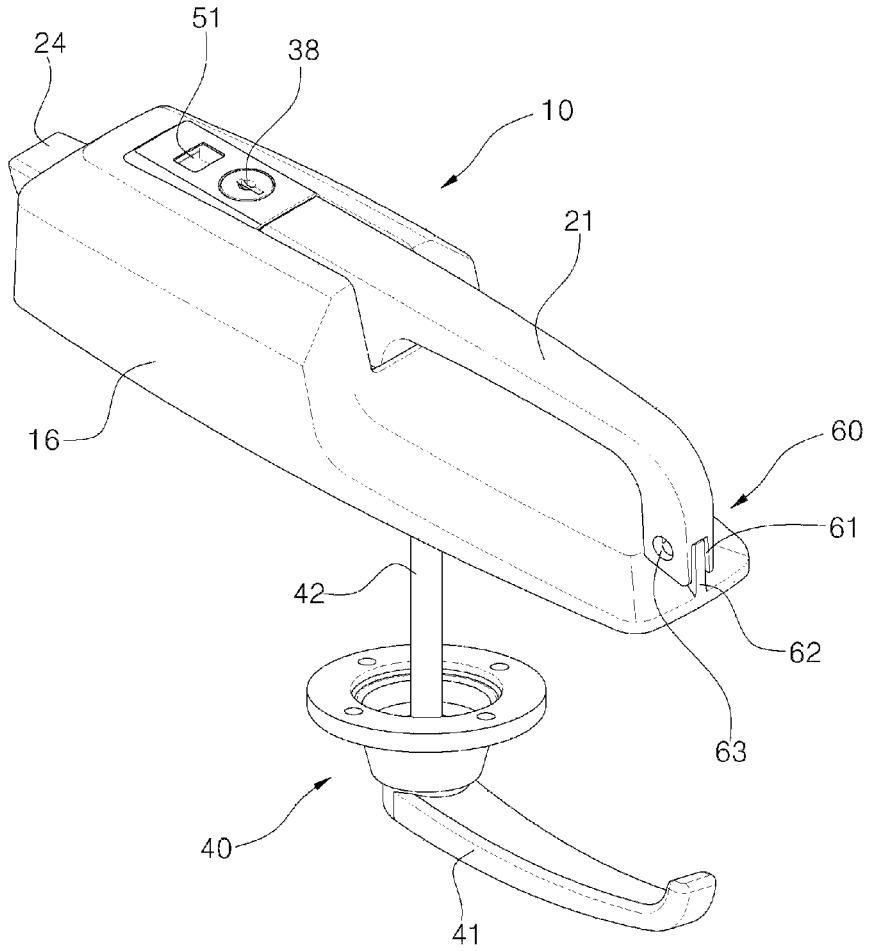
FIG. 2 is a perspective view showing the coupled state of the door lock device according to the present invention.
Figure 3:
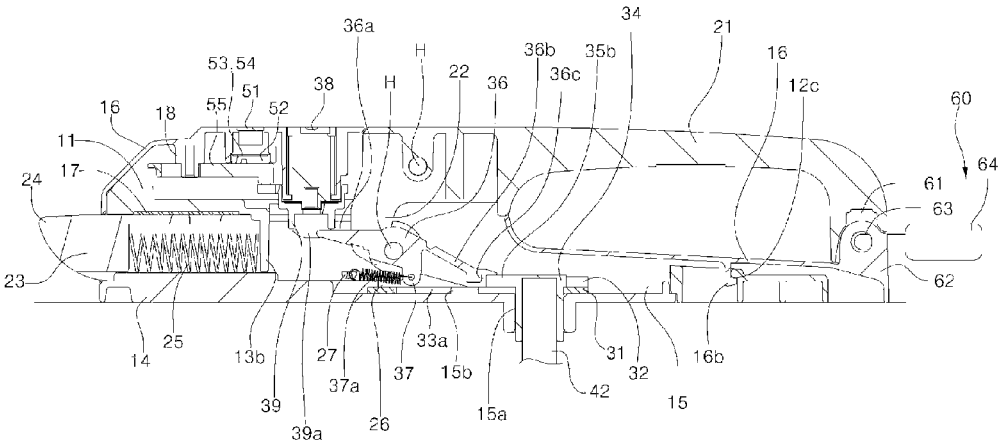
FIG. 3 is a sectional view showing the state where a latch is locked in the door lock device according to the present invention.
Figure 4:
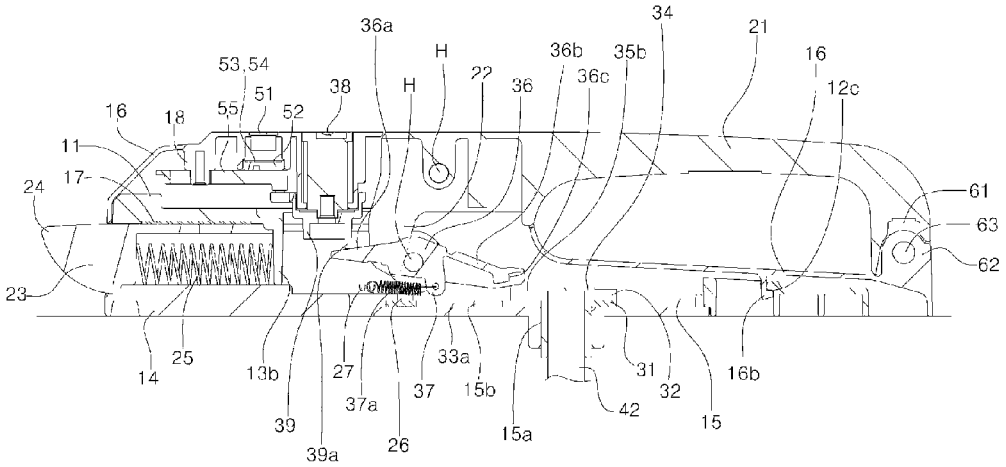
FIG. 4 is a sectional view showing the state where a locking plate is released from the locking state thereof in the door lock device according to the present invention.
Figure 5:
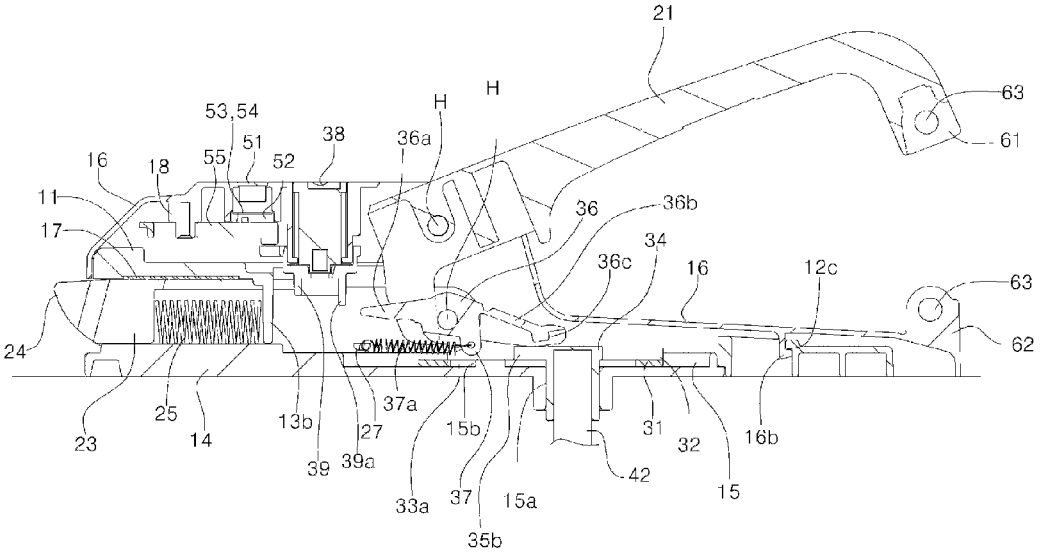
FIG. 5 is a sectional view showing the state where the locking state of the latch is released in the door lock device according to the present invention.
Figure 6:
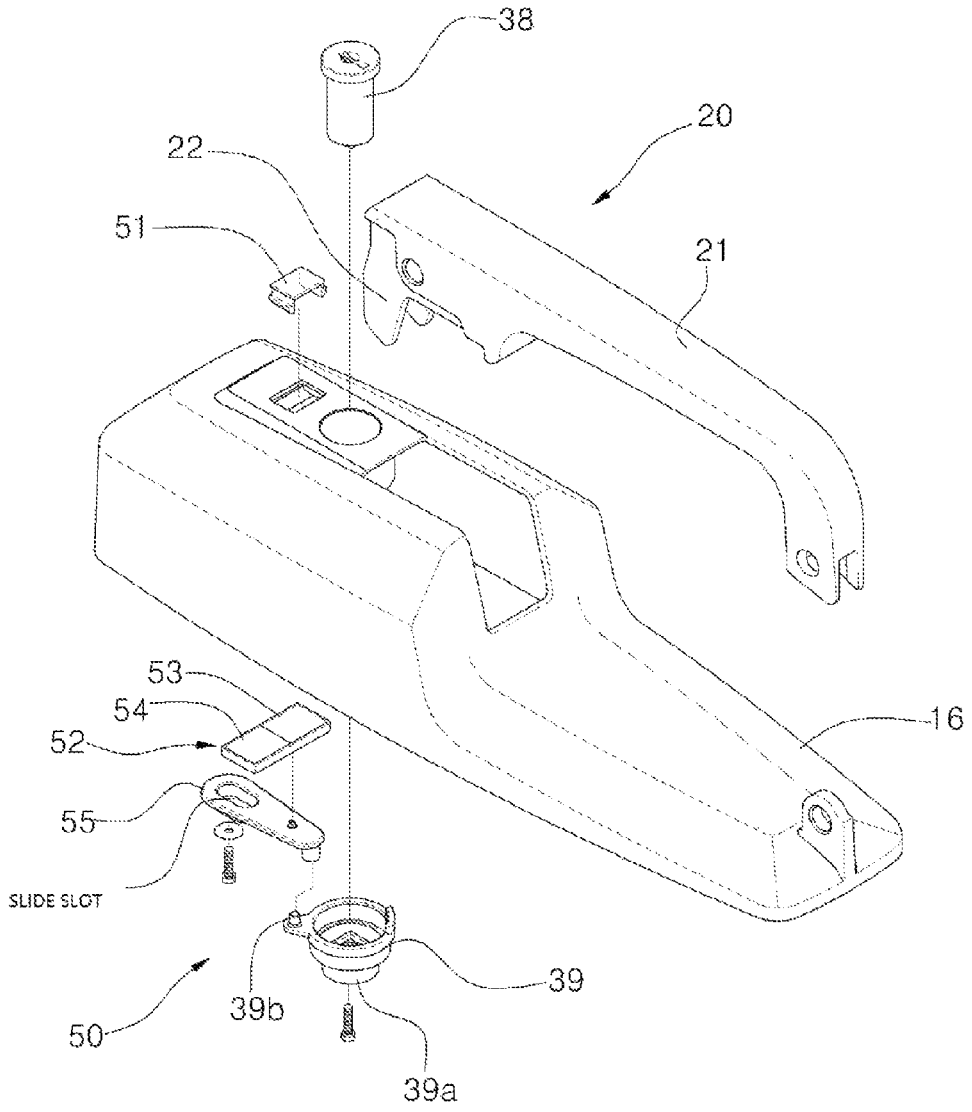
FIG. 6 is an exploded perspective view showing key locking and releasing display means in the door lock device according to the present invention.
Figure 7:
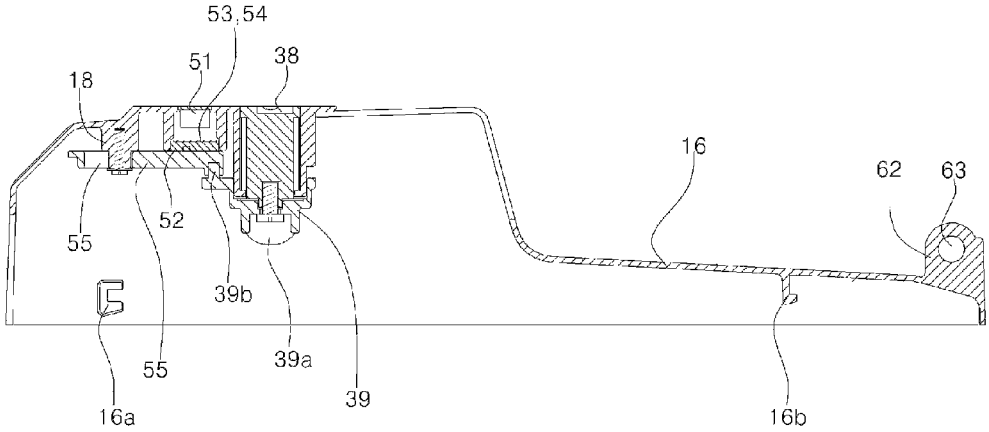
FIG. 7 is a sectional view showing the coupled state of FIG. 6.
Figure 8:
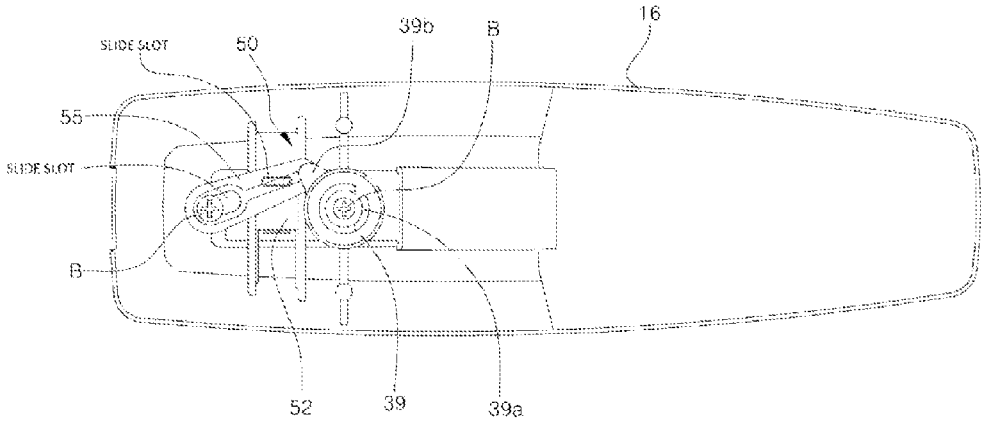
FIG. 8 is a bottom view showing the operating state where a releasing display portion of the key locking and releasing display means is seen through a transparent window in the door lock device according to the present invention.
Figure 9:
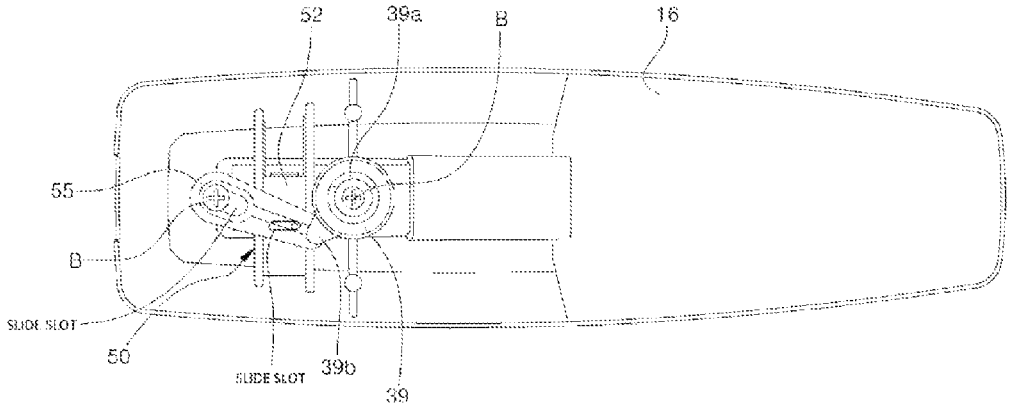
FIG. 9 is a bottom view showing the operating state where a locking display portion of the key locking and releasing display means is seen through a transparent window in the door lock device according to the present invention.

Referring to FIGS. 1 to 9, a door lock device for a door of a refrigerator and freezer according to the present invention includes: a case 10 having an inner case 11 fixed to the surface of the door and having a base plate 14 coupled to the underside thereof and an outer case 16 coupled to the external surface of the inner case 11; opening and closing means 20 adapted to move a latch 23 forward and backward by means of the operation of an outside handle 21 coupled to the inner case 11 to open and close the door; locking means 30 adapted to convert the latch 23 into a locking state in such a manner as to allow a fixing portion 36*b* of a locking plate 36 disposed at the rear portion of the latch 23 to be brought into close contact with a locking groove 35*a* formed on a rotary cam 34 disposed on the base plate 14 and a fixing plate 31; and releasing means 40 adapted to release the locking state of the latch 23 in such a manner as to allow the fixing portion 36*b* to be escaped from the locking groove 35*a* of the rotary cam 34 by means of the pushing operation of rotary protrusions 35 formed on the rotary cam 34 against the fixing portion 36*b*, thus causing pushing inducing protrusions 32 of the fixing plate 31 contacted with the rotary protrusions 35 to move backward.

The case 10, which is disposed on the surface of the door for the refrigerator and the freezer, has fixing frames 12 formed on both side surfaces of the inner case 11 to fix the case 10 to the door by means of bolts, bolt holes 12*a* formed at the inside of the fixing frames 12 to fix the inner case 11 to the door, fixing protrusions 12*b* protruding from the front portions of the fixing frames 12 in such a manner as to be press-fitted to fixing grooves 16*a* of the outer case 16 as will be discussed later, and a locking groove 12*c* formed at the inside of the rear portion of the inner case 11 in such a manner as to be coupled to a locking protrusion 16*b* of the outer case 16, thus preventing the locking state of the inner case 11 from being forcedly released to the outside.

The case 10 has side frames 13 protruding upward from the front portion of the inner case 11, and the side frames 13 are open on the front and bottom surfaces thereof and closed in the interior thereof in such a manner as to insert a lock 24 of the latch 23 as will be discussed later into the front surface thereof and to be coupled to the base plate 14 on the bottom surface thereof. The side frames 13 are coupled to a hinge shaft H at the top end portions of the rear portions thereof in such a manner as to allow the front portion of the outside handle 21 as will be discussed later to be rotatably shaft-coupled between the side frames 13 and the hinge shaft H, and the side frames 13 include guide plates 13*a* protruding inward from the inside thereof in such a manner as to prevent the locking plate 36 coupled to the latch 23 from being distorted, a spring support plate 13*b* protruding downward from the inside of the front portions thereof in such a manner as to maintain the state wherein the rear portion of an elastic spring 25 as will be discussed later is brought into close contact with the front surface thereof, a slide plate 17 disposed at the inside of the side frames 13 in front of the spring support plate 13*b* in such a manner as to be brought into close contact with the lock 24 of the latch 23, thus minimizing the frictional force generated upon the sliding movement.

The base plate 14 coupled to the underside of the inner case 11 by means of bolts has a seating portion 15 formed at the inside of the rear portion thereof in such a manner as to insert the fixing plate 31 thereinto and to slidingly move to perform a linear reciprocating motion, and the seating portion 15 has a cam hole 15*a* penetrated into the inner surface thereof in such a manner as to protrudingly insert the lower end periphery of the rotary cam 34 as will be discussed later thereinto and a support protrusion 15*b* protruding upward therefrom in front of the cam hole 15*a* in such a manner as to support the underside of the fixing portion 36*b* of the locking plate 36 thereagainst, thus maintaining the separated state of the fixing portion 36*b* from the seating portion 15.

The opening and closing means 20 coupled to the inner case 11 and the outer case 16 includes the outside handle 21 whose front portion is inserted into the inside of the inner case 11 and the outer case 16 and whose rear portion is extended toward the rear portion of the outer case 16, an operating lever 22 formed on the front portion of the outside handle 21 in such a manner as to be rotatably fixed to the side frames 13 on one end thereof by means of the hinge shaft H, the latch 23 disposed at the inside of the inner case 11 and the base plate 14 in such a manner as to move forward and backward by means of the operation of the outside handle 21 to open and close the door, the lock 24 extended from the front portion of the latch 23 in such a manner as to protrude from the front surfaces of the side frames 13, the elastic spring 25 whose front surface is brought into close contact with the interior of the front portion of the lock 24 and whose rear surface is brought into close contact with the spring support plate 13*b* of the side frames 13 in such a manner as to allow the lock 24 of the latch 23 to protrude from the front surfaces of the side frames 13, a hinge shaft H coupled to the rear portion of the latch 23 in such a manner as to fix the locking plate 36 as will be discussed later thereto and to be brought into contact with the operating lever 22 of the outside handle 21, so that if the outside handle 21 pulls, the operating lever 22 pushes the hinge shaft H to allow the latch 23 to move backward, and moving protrusions 26 protruding downward from the underside of the latch 23 to which the hinge shaft H is coupled in such a manner as to be inserted into first moving slots 33 of the fixing plate 31 and to slidingly move along the first moving slots 33.

The locking means 30 controlling the operation of the latch 23 includes the fixing plate 31 slidingly movably inserted into the seating portion 15 of the base plate 14, the pushing inducing protrusions 32 protruding upward from the rear portion of the fixing plate 31 in such a manner as to be brought into close contact with the rotary protrusions 35 of the rotary cam 34 as will be discussed later, the first moving slots 33 formed on both side surfaces of the front portion of the fixing plate 31 in such a manner as to insert the moving protrusions 26 of the latch 23 thereinto and to allow the moving protrusions 26 to slidingly move therealong, a second moving slot 33*a* extended to the portion where the pushing inducing protrusions 32 are formed at the inside of the first moving slots 33 and adapted to insert the support protrusion 15*b* of the base plate 14 thereinto to allow the fixing plate 31 to slidingly move around the support protrusion 15*b*, the rotary cam 34 whose lower end periphery is inserted into the inside of the rear portion of the second moving slot 33 in such a manner as to protrudingly pass through the cam hole 15*a* of the base plate 14, the rotary protrusions 35 protruding forward from both sides of the front portion of the rotary cam 34 and having a larger diameter than the rotary cam 34 in such a manner as to be brought into close contact with the top end portion of the fixing plate 31 and to allow the fixing plate 31 to come into contact with the base plate 14 to prevent the fixing plate 31 from being escaped from the base plate 14, the locking groove 35*a* formed between the rotary protrusions 35, a guide protrusion 35*b* extended from the front portion of the center of the locking groove 35*a* in such a manner as to be coupled to a guide groove 36*c* formed on the fixing portion 36*b* of the locking plate 36 as will be discussed later and to allow the guide groove 36*c* to move along the guide protrusion 35*b*.

The locking plate 36 is coupled to the inside of the hinge shaft H coupled to the rear portion of the latch 23, and the locking plate 36 includes a pressing portion 36*a* protruding forward from the front portion thereof, the fixing portion 36*b* protruding backward from the rear portion thereof in such a manner as to maintain the separated state from the fixing plate 31 by means of the support protrusion 15*b* formed on the base plate 14 and to be supported against the support protrusion 15*b*, and the guide groove 36*c* formed on the underside of the fixing portion 36*b* in such a manner as to be brought into close contact with the guide protrusion 35*b* of the rotary cam 34, so that upon the backward movement of the latch 23, the guide groove 36*c* of the fixing portion 36*b* moves along the guide protrusion 35*b* over the rotary cam 34 to cause the locking state of the latch 23 to be released, and the fixing portion 36*b* of the locking plate 36 is brought into close contact with the locking groove 35*a* of the rotary cam 34 to restrict the movement of the latch 23. At this time, the locking and releasing states of the latch 23 are maintained by means of the operation of a key spindle 38 coupled to the top plate of the outer case 16, and a key housing 39 is coupled under the key spindle 38, while having a locking protrusion 39*a* protruding from the center of the bottom portion of the key housing 39 in such a manner as to press and release the pressing portion 36*a*, thus allowing the fixing portion 36*b* of the locking plate 36 to be repeatedly fixed and escaped to and from the locking groove 35*a* of the rotary cam 34.

On the other hand, inclined surfaces 35*c* are formed at the inside of the rotary protrusions 35 of the rotary cam 34, and round portions are formed on both side surfaces of the fixing portion 36*b*, so that while the rotary protrusions 35 is rotating, the fixing portion 36*b* of the locking plate 36 lifts upward by means of the operation of the inclined surfaces 35*c* for pushing the round portions of the fixing portion 36*b* and is escaped from the locking groove 35*a*, thus allowing the locking state of the latch 23 to be rapidly released. The guide protrusion 35*b* and the guide groove 36*c* have a shape of "^" to allow the guide groove 36*c* to slidingly move along the guide protrusion 35*b*, and the latch 23 has a spring loop 27 formed on the underside surface of the rear portion thereof, while the locking plate 36 having a spring loop 37 formed on the underside surface thereof, so that the spring loop 27 and the spring loop 37 are coupled to each other by means of a spring 37*a* to allow the locking plate 36 to move up and down, thus causing the fixing portion 36*b* of the locking plate 36 to return to its original position after being escaped from the locking groove 35*a* by means of the elastic force of the spring 37*a*.

The releasing means 40 adapted to release the locking state of the latch 23 includes an inner handle 41 having a rotary shaft 42 coupled to the inside of the rotary cam 34 protruding from the underside of the base plate 14, so that if the inner handle 41 rotates, the rotary shaft 42 and the rotary cam 34 rotate to allow the rotary protrusions 35 of the rotary cam 34 to push the fixing portion 36*b* of the locking plate 36, thus causing the fixing portion 36*b* to be escaped from the locking groove 35*a*, and at this time, the rotary protrusions 35 rotate to allow the pushing inducing protrusions 32 of the fixing plate 31 to push backward, so that the fixing plate 31 slidingly moves in the seating portion 15 to the rear portion thereof and at the same time pulls the moving protrusions 26 of the latch 23 coupled to the first moving slots 33 to allow the latch 23 to move to the rear portion thereof, thus causing the locking state of the latch 23 to be released to open the door. In case where a person is locked in the interior of the refrigerator and the freezer, the inner handle 41 rotates to open the door.

Further, a transparent window 51 is disposed on the top plate of the outer case 16, and key locking and releasing display means 50 is coupled to the underside of the transparent window 51, thus allowing the locking and releasing states of the key spindle 38 to be recognized by the naked eyes of a user through the colors exposed to the outside through the transparent window 51, without having direct checking for the locking and releasing states of the key spindle 38, so that the damage and breakdown of the outer handle 21 in the process of forcibly pulling the outer handle 21 in the state of the locking state of the key spindle 38 can be in advance prevented.

The key locking and releasing display means 50 includes the transparent window 51 made of a transparent material in such a manner as to be coupled to the top plate of the outer case 16, a locking and releasing display member 52 coupled to the underside of the transparent window 51 and having a releasing display portion 53 and a locking display portion 54 in such a manner as to be slidingly operated in left and right sides, and a connection frame 55 coupled to the underside of the locking and releasing display member 52 and fixed at one end thereof to a post 18 formed at the inside of the outer case 16 by means of a bolt and at the other end thereof to a coupling protrusion 39*b* formed on the peripheral surface of the key housing 39, so that if the key spindle 38 and the key housing 39 rotate, the connection frame 55 rotates to convert the linear movements of the locking and releasing display member 52 to allow the releasing display portion 53 and the locking display portion 54 to be selectively exposed through the transparent window 51. The releasing display portion 53 has a red color to indicate that the key spindle 38 and the latch 23 are released, and the locking display portion 54 has a green color to indicate that the key spindle 38 and the latch 23 are locked, so that the colors exposed to the outside through the transparent window 51 can be easily recognized by the naked eyes of the user.

Separate locking means 60 is further disposed on the outer handle 21 and the outer case 16, and the separate locking means 60 includes an accommodating groove 61 formed at the inside of the end portion of the outer handle 21, an accommodated protrusion 62 protruding from the top portion of the rear portion of the outer case 16 in such a manner as to be inserted into the accommodating groove 61, and locking holes 63 formed penetratedly into the accommodating groove 61 and the accommodated protrusion 62 to fix the accommodating groove 61 and the accommodated protrusion 62 to each other by means of a lock 64.

Under the above-mentioned configuration, an operation of the door lock device for the door of the refrigerator and the freezer according to the present invention will be explained below.

In case of a large-sized refrigerator and freezer, users come and go frequently into and out of the refrigerator and freezer, and accordingly, they hold an individual key. So as to in advance prevent articles in the refrigerator and freezer from being stolen, in this case, a key should be inserted into the key spindle 38 frequently to repeatedly perform the locking and releasing states, which makes in inconvenient in use. According to the present invention, however, if the key is inserted into the key spindle 38 and rotates so as to open the door of the refrigerator and freezer, the locking protrusion 39*a* formed on the key housing 39 presses the pressing portion 36*a* of the locking plate 36 to allow the fixing portion 36*b* to be escaped from the locking groove 35*a* of the rotary cam 34, thus releasing the locking state of the latch 23.

If the locking state of the latch 23 is released, the outer handle 21 is open and lifted upward, and at this time, the operating lever 22 of the outer handle 21 moves the hinge shaft H fixed together with the latch 23 backward, so that the moving protrusions 26 of the latch 23 slidingly move along the first moving slots 33 of the fixing plate 31 to allow the lock 24 of the latch 23 to be separated from a catcher (not shown) formed on the side surface of the door, thus opening the door.

On the other hand, since the user cannot check the locking state of the key spindle 38 in the process where the door of the refrigerator and freezer is open to move the articles, the outer handle 21 forcibly pulls frequently in the state where the key spindle 38 is locked, thus causing the operating lever 22 of the outer handle 21 to be broken or causing the hinge shaft H of the latch 23 to be broken, thus failing to open the door. According to the present invention, however, the colors of the key locking and releasing display means 50 are recognized by the naked eyes of the user through the transparent window 51 coupled to the top plate of the outer case 61, thus allowing the locking and releasing states of the key spindle 38 to be rapidly checked.

If the red color of the releasing display portion is exposed through the transparent window 51, the locking states of the latch 23 and the outer handle 21 are released so that there is no separate need for inserting the key into the key spindle 38 to perform the releasing operations for the latch 23 and the outer handle 21. If the green color of the locking display portion 54 is exposed through the transparent window 51, the locking states of the latch 23 and the outer handle 21 are easily recognized. Further, the colors exposed through the transparent window 51 can be easily recognized even from far away, and even if the locking state of the outer handle 21 is forgotten by the user due to his or her busy work, accordingly, the locking state can be checked rapidly.

So as to convert the releasing state of the door into the locking state thereof after the completion of the work in the refrigerator and freezer, if the key is inserted into the key spindle 38 and rotates, the locking protrusion 39*a* of the key housing 39 is separated from the pressing portion 36*a* to allow the fixing portion 36*b* of the locking plate 36 to be brought into close contact with the locking groove 35*a* of the rotary cam 34, so that the latch 23 does not move to maintain the fixed state together with the outer handle 21, and the green color of the locking display portion 54 is exposed to the outside through the transparent window 51.

The colors exposed through the transparent window 51 may include various colors, and light layers may be further formed on the colors of the releasing display portion 53 and the locking display portion 54, thus being easily recognized even during the night. While the key housing 39 is rotating, the connection frame 55 of the key locking and releasing display means 50, which is coupled to the coupling protrusion 39*b* of the key housing 39, rotates together, and the opposite side of the connection frame 55 is fixed to the post 18 formed at the inside of the outer case 16 by means of the bolt. A slide slot is formed on the inside of the connection frame 55 fixed by means of the bolt to the key housing 39 and moves in left and right sides around a bolt B in such a manner as to rotate together with the key housing 39. Further, a protrusion formed on the top of the connection frame 55 moves along a slide slot formed on the underside of the locking and releasing display portion 52 to allow the locking and releasing display portion 52 to be linearly reciprocated in left and right sides.

On the other hand, if a person is locked in the interior of the refrigerator and the freezer, the inner handle 41 fixed to the inner surface of the door rotates, and accordingly, the rotary shaft 42 of the inner handle 41 and the rotary cam 34 rotate together. At this time, the rotary protrusions 35 of the rotary cam 34 push the pushing inducing protrusions 32 of the fixing plate 31 backward to allow the fixing plate 31 to slidingly move in the seating portion 15 of the base plate 14, so that the moving protrusions 26 coupled to the first moving grooves 33 of the fixing plate 31 pull backward to allow the latch 23 to move backward, thus releasing the locking state of the latch 23.

In the process where the locking state of the latch 23 is released, if the inclined surfaces 35*c* formed on the rotary protrusions 35 of the rotary cam 34 push the round portions formed on the underside surface of the fixing portion 36*b*, the fixing portion 36*b* is escaped from the locking groove 35*a* to cause the guide groove 36*c* of the fixing portion 36*b* to be escaped from the guide protrusion 35*b*, thus releasing the locking state of the latch 23.

If the door of the refrigerator and the freezer is open, the latch 23 moves to its original position by means of the elastic force of the elastic spring 25, and the slide plate 17 is disposed between the inner case 11 and the lock 24 to minimize the generation of the frictional force when the latch 23 slidingly moves at the inside of the inner case 11.

The outer case 16 is adapted to surround the external surface of the inner case 11 to prevent the inner case 11 from being forcedly disassembled to the outside, and further, the locking states of the outer handle 21 and the latch 23 are easily recognized through the transparent window 51 to prevent the outer handle 21 and the latch 23 from being broken when they forcibly pull. Also, the accommodated protrusion 62 formed on the end portion of the outer case 16 is inserted into the accommodating groove 61 formed on the end portion of the outer handle 21, and the lock 64 is fixed to the locking holes 63, so that double locks can be utilized.

As described above, the door lock device for a door of a refrigerator and freezer according to the present invention is configured to improve the coupling structure of the inner case and the outer case and at the same time to reduce the whole volumes and the number of parts of the opening and closing means and the releasing means adapted to open and close the door, thus reducing the cost of the product, making it easy to perform assembling and installing processes, and improving the productivity of the product.

Further, the door lock device for a door of a refrigerator and freezer according to the present invention is configured wherein the fixing protrusions protruding from both side surfaces of the inner case are press-fitted to the fixing grooves formed on the inside of the front portion of the outer case, thus easily performing the coupling and separating processes, and the locking protrusion formed on the inside of the rear portion of the outer case is rigidly fixed to the locking groove of the inner case, thus preventing the inner case from being exposed to the outside and allowing the outer case to surround the external surface of the inner case to improve the outer appearance of the device.

Furthermore, the door lock device for a door of a refrigerator and freezer according to the present invention is configured wherein in the process where the fixing portion of the locking plate fixed to the latch as the opening and closing means is fixed to and escaped from the locking groove of the rotary cam, the rotary protrusions of the rotary cam push the side surfaces of the fixing portion through the inclined surfaces formed thereon to allow the fixing portion to be lifted upward from the rotary cam and to rapidly release the locking state of the latch, thus minimizing the number of parts for releasing the locking state of the latch, and wherein the guide plates are disposed at the inside of the inner case, thus preventing the locking plate from being distorted upon the movement of the latch.

Additionally, the door lock device for a door of a refrigerator and freezer according to the present invention is configured to have the transparent window coupled to the top plate of the outer case and the key locking and releasing display means mounted under the transparent window in such a manner as to be slidingly moved in left and right sides, so that if the latch is released, the color of the releasing display portion is exposed to the outside through the transparent window, and if the latch is locked, the color of the locking display portion is exposed to the outside through the transparent window, thus making it easy to recognize the colors by the naked eyes of a user and in advance preventing the outer handle from being broken due to the forcible pulling when the latch is locked.

In case of a large-sized refrigerator and freezer, moreover, users come and go frequently into and out of the refrigerator and freezer, and accordingly, they hold an individual key. In this case, they do not check whether the key of the key spindle is locked or released due to their busy work, so that articles in the refrigerator and freezer are frequently stolen. According to the present invention, however, they can recognize that the key of the key spindle is released just with the color exposed through the transparent window, and at that moment, they can convert the releasing state into the locking state.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A door lock device for a door of a refrigerator and freezer, the device comprising:

a case 10 having an inner case 11 fixed to the door by means of bolts, a base plate 14 fixed to the underside of the inner case 11 by means of bolts in such a manner as to close the interior of the inner case 11, fixing frames 12 formed on both side surfaces of the inner case 11 and having fixing protrusions 12*b* protruding from the front portions thereof, a locking groove 12*c* formed at the inside of the rear portion of the inner case 11, and an outer case 16 having fixing grooves 16*a* formed at the inside thereof in such a manner as to allow the fixing protrusions 12*b* of the inner case 11 to be press-fitted thereto and a locking protrusion 16*b* formed on the inside of the rear portion thereof in such a manner as to be fixed to the locking groove 12*c* of the inner case 11;

opening and closing means 20 having an outside handle 21 having an operating lever 22 disposed on the front portion thereof in such a manner as to be fixed on one end thereof to the inner case 11 by means of a hinge shaft, the other end of the outside handle 21 being extended to the rear portion of the outer case 16, and a latch 23 disposed between the inner case 11 and the base plate 14 in such a manner as to allow the operating lever 22 of the outer handle 21 to be brought into close contact with a hinge shaft H coupled to the rear portion thereof, so that the hinge shaft H and the latch 23 move backward to open the door;

locking means 30 having a fixing plate 31 inserted into the inside of the rear portion of the base plate 14, pushing inducing protrusions 32 protruding upward from the rear portion of the fixing plate 31, a rotary cam 34 penetrated into the inside of the fixing plate 31 in such a manner as to allow the lower peripheral portion thereof to protrude from the underside of the base plate 14, rotary protrusions 35 formed on both sides of the front portion of the rotary cam 34 in such a manner as to allow the fixing plate 31 to be brought into close contact with the base plate 14, a locking groove 35*a* formed on the center of the rotary protrusions 35, a guide protrusion 35*b* extended forward from the locking groove 35*a*, a locking plate 36 fixed to the hinge shaft of the latch 23 and having a pressing portion 36*a* formed on the front portion thereof and a fixing portion 36*b* formed on the rear portion thereof in such a manner as to be brought into close contact with the locking groove 35*a* of the rotary cam 34 and escaped therefrom through the seesaw operation of the pressing portion 36*a*, a key spindle 38 and a key housing 39 coupled to the top plate of the outer case 16, and a locking protrusion 39*a* protruding from the underside of the key housing 39 in such a manner as to press and release the pressing portion 36*a*; and releasing means 40 having an inner handle 41 having a rotary shaft 42 inserted into the inside of the rotary cam 34 protruding from the underside of the base plate 14 in such a manner as to allow the rotary protrusions 35 of the rotary cam 34 to lift the fixing portion 36*b* of the locking plate 36 upward through the rotation of the inner handle 41 and to allow the fixing portion 36*b* to be escaped from the guide protrusion 35*b*, so that the rotary protrusions 35 of the rotary cam 34 push the pushing inducing protrusions 32 backward to release the locking state of the latch 23.

2. The door lock device according to claim 1, wherein the case 10 has bolt holes 12*a* formed at the inside of the fixing frames 12 to fix the inner case 11 to the door and side frames 13 protruding upward from the front portion of the inner case 11 in such a manner as to allow the inner case 11 to be open on the front and bottom surfaces thereof, the side frames having a hinge shaft H coupled to the top end portions of the rear portions thereof in such a manner as to allow the outside handle 21 to be fixed thereto, guide plates 13*a* protruding inward from both side surfaces of the rear portion thereof in such a manner as to prevent the locking plate 36 coupled to the latch 23 from being distorted, and a spring support plate 13*b* disposed at the inside thereof in front of the guide plates 13*a*.

3. The door lock device according to claim 2, wherein the case 10 has a slide plate 17 disposed at the top portion of the inside of the front portions of the side frames 13.

4. The door lock device according to claim 1, wherein the base plate 14 is coupled to the underside of the inner case 11 by means of bolts and has a seating portion 15 formed at the inside of the rear portion thereof in such a manner as to insert the fixing plate 31 thereinto, a cam hole 15*a* penetrated into the inner surface of the seating portion 15, and a support protrusion 15*b* protruding upward from the seating portion 15 in front of the cam hole 15*a* in such a manner as to support the underside of the fixing portion 36*b* of the locking plate 36 thereagainst.

5. The door lock device according to claim 1, wherein the opening and closing means 20 has a lock 24 extended from the front portion of the latch 23, an elastic spring 25 coming into close contact with the interior of the lock 24 on one end thereof and with a spring support plate 13*b* on the other end thereof in such a manner as to allow the latch 23 to press and move forward, moving protrusions 26 protruding downward from the underside of the latch 23 to which the hinge shaft H is coupled in such a manner as to move along first moving slots 33 formed on both side surfaces of the fixing plate 31, a second moving slot 33*a* formed at the inside of the first moving slots 33 on the fixing plate 31 in such a manner as to insert the support protrusion 15*b* of the base plate 14 thereinto to allow the fixing plate 31 to slidingly move around the support protrusion 15*b*, and a spring loop 27 formed on the underside surface of the rear portion of the latch and coupled to a spring loop 37 formed on the underside surface of the locking plate 36 by means of a spring 37*a*, so that the spring loop 27 and the spring loop 37 are coupled to each other to allow the fixing portion 36*b* of the locking plate 36 to elastically move up and down.

6. The door lock device according to claim 1, wherein the locking means 30 has inclined surfaces 35*c* formed at the inside of the rotary protrusions 35 of the rotary cam 34, round portions formed on both side surfaces of the fixing portion 36*b* of the locking plate 36 in such a manner as to allow the inclined surfaces 35*c* of the rotary protrusions 35 to push the round portions to move the underside of the fixing portion 36*b* over the rotary cam 34, thus releasing the locking state of the latch 23, and a guide groove 36*c* formed on the underside of the fixing portion 36*b* in such a manner as to be coupled to the guide protrusion 35*b* of the rotary cam 34, the guide protrusion 35*b* and the guide groove 36*c* having a shape of "^".

7. The door lock device according to claim 1, wherein the key spindle 38 of the locking means 30 is adapted to insert a key into the top portion thereof in such a manner as to have the lower end periphery thereof inserted into the interior of the outer case 16, and the key housing 39 is fixed to the underside of the key spindle 38 by means of bolts in such a manner as to rotate unitarily with the key spindle 38, the key housing 39 having the locking protrusion 39*a* protruding from the underside thereof in such a manner as to press and release the pressing portion 36*a* of the locking plate 36 and to control the operation of the latch 23.

8. The door lock device according to claim 1, further comprising key locking and releasing display means 50 having a transparent window 51 disposed on the top plate of the outer case and a releasing display portion 53 and a locking display portion 54 formed at the inside of the transparent window 51 in such a manner as to allow colors of the releasing display portion 53 and the locking display portion 54 to be selectively displayed in accordance with the locking and releasing states of the key spindle 38, thus allowing the colors exposed through the transparent window 51 to be recognized by the naked eyes of a user.

9. The door lock device according to claim 8, wherein the key locking and releasing display means 50 has the transparent window 51 made of a transparent material in such a manner as to be coupled to the top plate of the outer case 16, a locking and releasing display member 52 coupled to the underside of the transparent window 51 and having the releasing display portion 53 and the locking display portion 54 in such a manner as to be slidingly operated in left and right sides, and a connection frame 55 coupled to the underside of the locking and releasing display member 52 and fixed at one end thereof to a post 18 formed at the inside of the outer case 16 by means of a bolt and at the other end thereof to a coupling protrusion 39*b* formed on the outer peripheral surface of the key housing 39, so that if the key spindle 38 and the key housing 39 rotate, the connection frame 55 rotates to convert the linear movements of the locking and releasing display member 52 to allow the colors of the releasing display portion 53 and the locking display portion 54 to be selectively exposed through the transparent window 51.

10. The door lock device according to claim 1, further comprising locking means 60 adapted to unitarily couple the end portion of the outer handle 21 to the top portion of the rear portion of the outer case 16 and to fix the coupled outer handle 21 and the outer case 16 to each other by means of a lock 64.

11. The door lock device according to claim 10, wherein the locking means 60 has an accommodating groove 61 formed at the inside of the end portion of the outer handle 21, an accommodated protrusion 62 protruding from the top portion of the rear portion of the outer case 16 in such a manner as to be inserted into the accommodating groove 61, and locking holes 63 formed penetratedly into the accommodating groove 61 and the accommodated protrusion 62 in such a manner as to fix the accommodating groove 61 and the accommodated protrusion 62 to each other by means of the lock 64.

* * * * *